United States Patent [19]

Roebuck

[11] Patent Number: 4,532,684

[45] Date of Patent: Aug. 6, 1985

[54] BUTTON ASSEMBLER

[75] Inventor: Malcolm J. Roebuck, Williamsburg, Va.

[73] Assignee: Bagde-A-Minit Ltd., La Salle, Ill.

[21] Appl. No.: 557,748

[22] Filed: Dec. 5, 1983

[51] Int. Cl.[3] ..... B21F 45/28; D04D 7/04

[52] U.S. Cl. ..... 29/4; 79/5

[58] Field of Search ..... 29/4; 79/5, 3, 4

[56] References Cited

U.S. PATENT DOCUMENTS

| | | | |
|---|---|---|---|
| 2,814,220 | 11/1957 | Spendel et al. | 79/5 |
| 3,214,811 | 11/1965 | Adonolfi | 79/5 |
| 3,282,134 | 11/1966 | Itoh | 79/5 |
| 3,548,689 | 12/1970 | Newig | 79/5 |
| 3,643,530 | 2/1972 | Roebuck | 79/5 |
| 3,661,039 | 5/1972 | Lewis | 79/5 |
| 3,858,462 | 1/1975 | Orlando et al. | 79/5 |
| 3,863,527 | 4/1975 | Berning | 79/5 |

*Primary Examiner*—Mark Rosenbaum
*Assistant Examiner*—Steven Nichols
*Attorney, Agent, or Firm*—Wm. A. Snow

[57] ABSTRACT

A device to assemble buttons of the type having a safety pin associated with a fastening member including an outer shell having a covering. The present invention is directed to the mechanism snap-out of the finished button and a cam and bar for automatically adjusting the length of travel of the upper die.

3 Claims, 8 Drawing Figures

BUTTON ASSEMBLER

BACKGROUND OF THE INVENTION

This invention is an improvement on my U.S. Pat. No. 3,643,530 granted Feb. 22, 1972. The known art is U.S. Pat. Nos. 738,062, 701,116, 776,597, 710,621, 671,870 and 772,669. However, none of the patents even remotely disclose the present invention.

SUMMARY OF THE INVENTION

In a button making machine of the type shown in my U.S. Pat. No. 3,643,530, the improvement being a finished button release mechanism and a bar having depending short rods thereon, the bar having one end extending beyond the upper cutting die and limited rotary means below the lower forming die having a vertically extending cam means thereon to shift the cam means away from or toward said bar whereby the upper die will shift either partially in said lower die or extend further inward into said lower die.

DETAILED DESCRIPTION OF THE DRAWINGS

Figure 1:
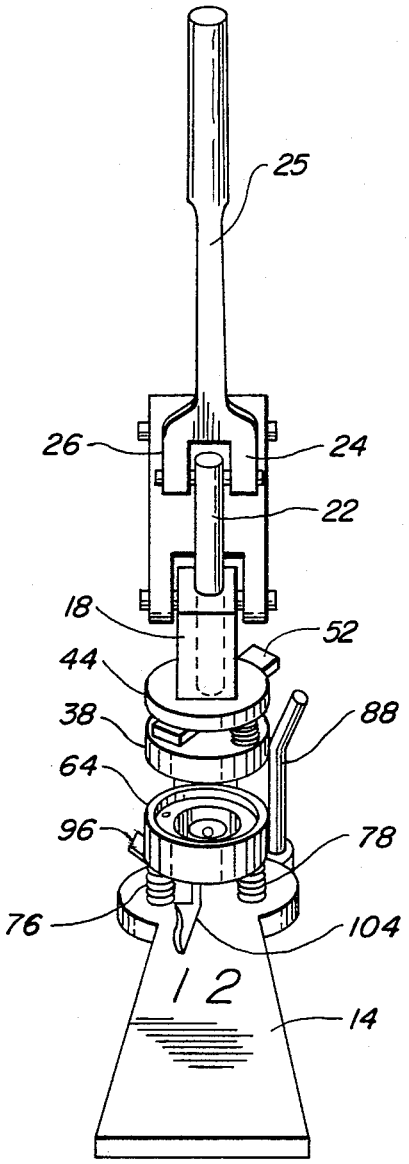
FIG. 1 is a front perspective view of the device of the present invention.
Figure 5:
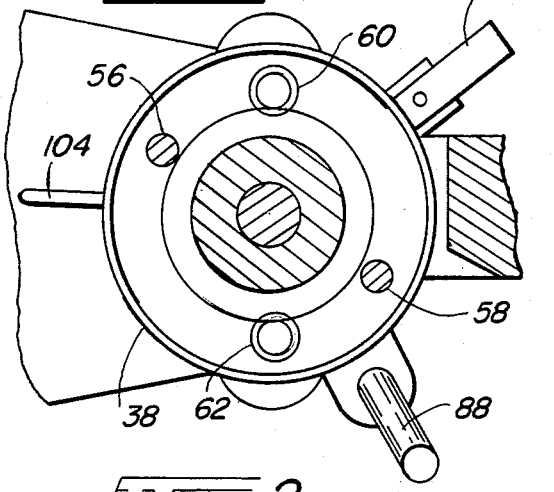
FIG. 5 is a cross-sectional view taken on the line 5—5 of FIG. 2 but showing the cam means in operative position.

The device of the present invention consists of a frame 10 in the shape of a reverse "C" having a base 12, a forwardly, outwardly and downwardly flaring extension 14, a rear leg 16, and an inwardly and outwardly extending upper extension 18, all these elements being integrally formed together and having substantial thickness.

The upper extension 18 is provided with a through aperture 20 in which a vertical shaft 22 extends. The upper end of the shaft 22 is pivotally secured to a clevis 24 to which an elongated handle 25 is integrally formed.

A second clevis 26 is pivotally secured to the upper member 18. Integrally formed to the upper end of the clevis is a wide piece of metal 28 of substantial thickness terminating in an upwardly and inwardly portion 30 hollowed out to form a clevis to be pivotally anchored to the extension 32 which is integrally formed on the lower end of the handle 25 which is pivotally secured therein. The lower end of the extension 32 is provided with an integrally formed depending rod 34 about which a compression spring 36 is seated to retain the handle in its vertical position. (See FIGS. 2 and 3.) The lower end of the rod seats in a through aperture 37 in the member 18 between shaft 22 and the diagonal extension 28.

The upper die 38 comprises an annular member 40 of substantial thickness hollowed out to form a depending integral ridge 42 and has a circular opening axially therein as at 43 housing a movable circular plate 44.

An enlarged circular plate 46 of the same diameter as the die 40 is spaced thereabove and anchored axially adjacent the lower end of the shaft 22. The plate 46 is spacedly positioned above the die 40 by a short, heavy, circular collar 48 integrally secured to plate 46 and the movable plate 44 positioned axially in the upper die 40.

Figure 2:
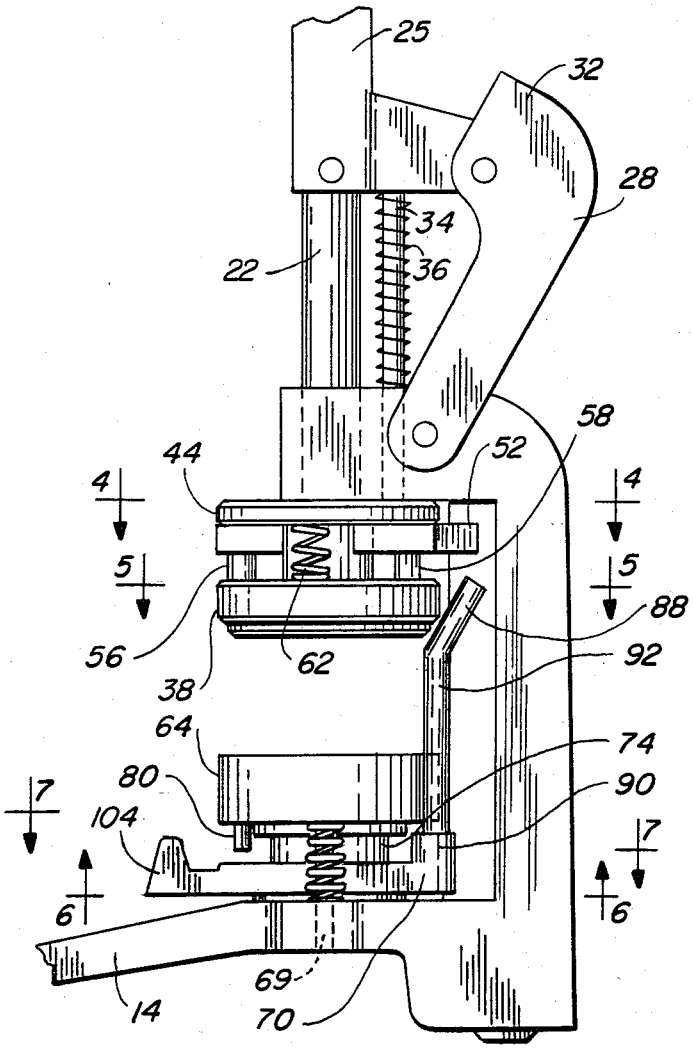
FIG. 2 is a side view of FIG. 1 with the handle broken away.
Figure 3:
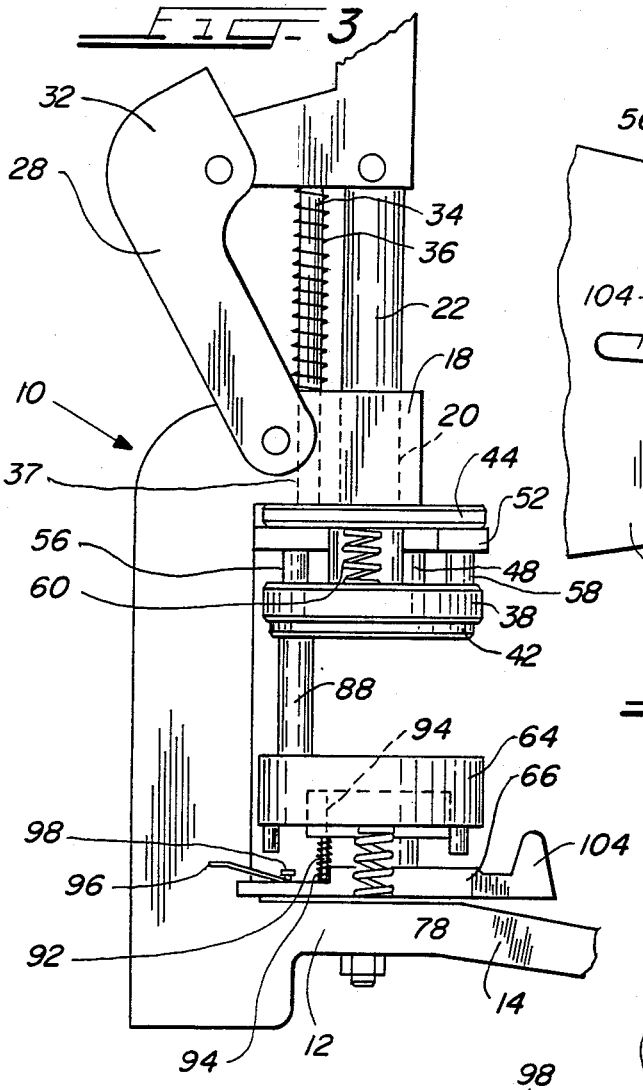
FIG. 3 is a side view of the device of FIG. 1, with parts broken away, of the side opposite that of FIG. 2.
Figure 4:
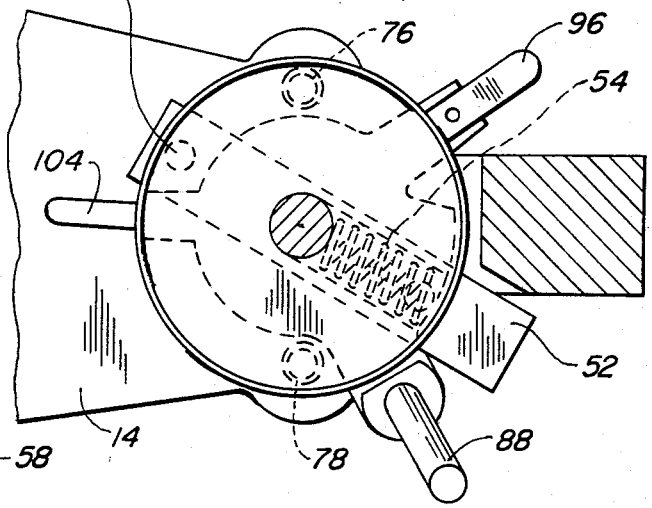
FIG. 4 is a cross-sectional view taken on the line 4—4 of FIG. 2 showing the cam means in inoperative position.
Figure 6:
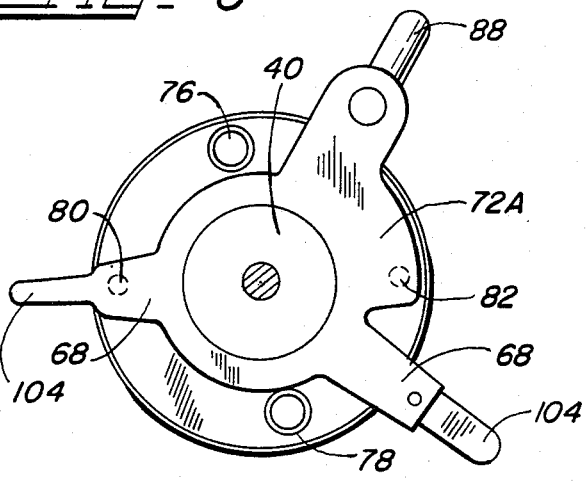
FIG. 6 is a cross-sectional view taken on the line 6—6 of FIG. 2.

The collar 48 is provided with a rectangular, through, transverse channel 50 therein to seat an elongated bar 52 which reciprocates therein. The bar 52 also is provided with a horizontally positioned compression spring 54 interiorly in a cutout to position the bar, as shown in FIGS. 2, 3 and 4. The spring 54 bears against the shaft 20 and one end of the cutout in the bar. The bar 52 is also provided with depending rods 56, 58 of the same length as shown in the drawing secured thereto. The rods are loosely seated on the outer periphery of the upper die 42 and are shiftable with the bar 52.

A pair of vertically positioned compression springs 60, 62 are opposedly positioned between the upper surface of the die 44 and plate 46 adjacent the outer surface of each. Each spring 60, 62 is secured to the plate 46 to normally keep the plate and upper die separated.

The lower die 64 comprises an inner configuration substantially as shown in U.S. Pat. No. 3,643,530. The die 64 is axially positioned below the upper die 40 and cooperates therewith, as will hereinafter be obvious.

Figure 7:
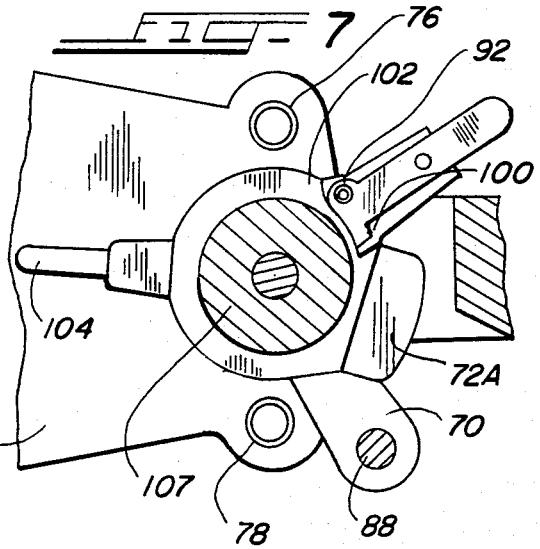
FIG. 7 is a cross-sectional view taken on the line 7—7 of FIG. 2.

A bottom plate 66 has three short, integral, radial extensions 68, 70 and 72 being approximately 120° apart and a fourth land **72*a* (see FIG. 7) and is rotatively seated on the base 12 and is provided with an axial aperture to rotatively seat around the lower end of the collar 74**.

The depending, axially positioned collar 74 substantial diameter is integrally formed on the upper end of plate 66 and slidable axially in the interior of the lower die. A pair of opposed compression springs 76, 78 support the lower die 64 in its upward position, as shown in FIG. 2.

A pair of opposed rods 80, 82 integrally depend from the lower die 64 adjacent the edges thereof and are encompassed by the respective springs 76, 78. The lower end of the rods 80, 82 slidably seat in through apertures 84, 86, respectively, in the base 14. The lower end of the springs 76, 78 seat on the extensions 68, 70.

An elongated rod 88 in the form of a cam seats at one end in and is secured to a hub 90 formed on the extension 72 of the lower plate 66 and the upper end cooperates with the end of the slidable bar 52 to shift it inwardly when in position.

A finishing button is released from the lower die 64 by rod 92 slidingly shifted upwardly in the aperture 94 (see FIG. 1) against the action of spring 92. The spring plate 96 is loosely anchored to the extension 68 by a headed pin 98. As noted in FIG. 3, the spring at its outer end is bent upwardly and outwardly and the opposite inner end has an elongated, flat, transverse "T" portion 100 on which the rod is loosely seated. Thus the spring acts as a cantilever. A spring 96 surrounds the rod 92 to return the rod to its lower position seated on the portion 100. The extension 68 is provided with a cutout 102 whereby the spring 96 will not shift as the lower plate 66 rotates and also the ends of the cutout 102 limit the rotary movement of the lever 102 as well as the spring 78 which will bear against the extension 70.

In operation, the button parts shown in U.S. Pat. No. 3,643,530 are placed in the lower die as explained in the foregoing patent. The lever 104 is shifted to the number 1 position. (See FIG. 1.) The handle 25 is then moved forwardly and downwardly, causing the shaft 22 and upper die 40 to shift downwardly vertically to mate with the lower die 64 and urge it downwardly with the rods 56, 58 on the plate 52 pressing against the upper die 38 and the inner circular plate 44 in at rest position in the upper die 40, i.e. no axial movement as the lower ends of rods 56, 58 bear against the peripheral edge of the upper die 40.

The lower die is shifted downwardly against the action of springs 76, 78 and the rods 80, 82 will bear against the plate 66 to allow the mass to move downwardly about 3/16ths of an inch to partially assemble the button.

Figure 4A:
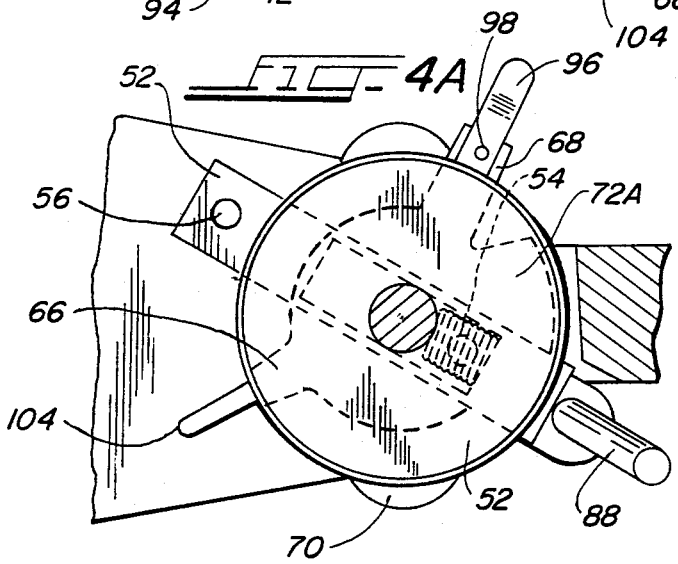
FIG. 4A is the same as FIG. 4 but with the rod cam having moved the bar outwardly.

By shifting the lever 104 to the right or to number 2 (see FIG. 1), the rod will be shifted rearwardly rotatively towards the vertical portion of frame 10 (see FIG. 4A) and the following action takes place.

On downward and forward movement of the handle, the upper die will be lowered. Simultaneously the bar 52 will shift outwardly towards the left, caused by engagement against the cam rod 88, thereby moving the bar 52 outwardly of the edge of the upper die 40 and the rod 58 inwardly over the cylindrical portion 40 so as to cause the cylindrical plate 40 to shift downwardly axially. On further movement of the handle, the cylindrical portion 40 will move downwardly by the movement of the collar 23 and will crimp the button parts together in the lower die to partially crimp the button parts together.

On release of the handle, the spring 36 will shift the handle to the vertical. The springs 60, 62 will shift the upper die away from the plate 44 and move the collar 23 and cylindrical portion 40 to return to the position shown in FIG. 2 and the springs 76, 78 will raise the lower die away from plate 66.

The finished button will be housed in the lower die and by pressing the raised portion of the spring 96, the end 100 will cause the rod 92 to move upwardly in the aperture 94 contacting the finished button and releasing it from the die.

Although but one specific embodiment of this invention is herein shown and described, it will be understood that details of the construction shown may be altered or omitted without departing from the spirit of the invention as defined by the following claims.

I claim:

1. A button making apparatus having a movable upper die having an inner shiftable portion and a stationary lower die, an annular plate above said upper die, an annular collar positioned between said plate and said upper die and secured to both, said collar having a horizontally disposed, through, rectangular aperture therein and shiftable therein, an elongated, rectangular in vertical cross-section bar in said aperture and extending outwardly thereof, a medial opening in said bar and a compression spring in said opening to urge the bar in inoperative position, a pair of opposed rods depending from said bar to contact the periphery of said upper die in inoperative position.

2. The apparatus of claim 1 wherein said lower die is provided with means to remove a finished button therefrom comprising a spring having one end curved upwardly and the other end having an integral, right angled extension, said lower die having a through aperture therein, a thin rod shiftable in said aperture, the lower end of said pin seated on said extension, a partially rotatable plate seated below said lower die having a cutaway portion in which said extension seats so when said plate is rotated, said spring does not shift.

3. The apparatus of claim 2 wherein a cam rod extends upwardly and is secured to said latter plate whereby when said plate is rotated to the right, the cam rod will contact said bar when the upper die is shifted from its position and shift said bar and its rods from its inoperable position to an operable position, one of said rods onto the said inner portion of said upper die and the other away from said upper die whereby when said rotatable plate is shifted to the left, the cam rod will shift away from said bar and the spring in said bar will shift it to inoperable position.

* * * * *